US005078437A

United States Patent [19]

Borgmeyer et al.

[11] Patent Number: 5,078,437

[45] Date of Patent: Jan. 7, 1992

[54] TRANSFORMER HAVING AN INTEGRAL CABINET WITH DOOR LATCHING AND LOCKING APPARATUS

[75] Inventors: Virgil L. Borgmeyer, Meta; Chester F. Trice, Jefferson City; Dale A. Tempco, Jefferson City; Thomas F. Clark, Jefferson City; William J. Ritter, Tebbetts; Mari Marisiddaiah, Jefferson City, all of Mo.

[73] Assignee: ABB Power T&D Company, Inc., Blue Bell, Pa.

[21] Appl. No.: 664,945

[22] Filed: Mar. 5, 1991

[51] Int. Cl.[5] ..... E05C 3/10

[52] U.S. Cl. ..... 292/206; 292/31; 292/251; 174/52.1

[58] Field of Search ..... 292/206, 251, 7, 205, 292/31; 70/232; 174/52 R

[56] References Cited

U.S. PATENT DOCUMENTS

| | | | |
|---|---|---|---|
| 3,039,837 | 6/1962 | Poe | 312/320 |
| 3,784,727 | 1/1974 | Haubein | 174/52 |
| 4,078,843 | 3/1978 | Bozich | 292/57 |

*Primary Examiner*—Richard E. Moore

*Attorney, Agent, or Firm*—Woodcock Washburn Kurtz Mackiewicz & Norris

[57] ABSTRACT

An electrical transformer having an integral cabinet with an apparatus for latching and locking the doors of the cabinet. The apparatus is comprised of a three point latch system. The first and second latch points are vertical latch rods which engage sills in the cabinet. The third latch point is a latch plate which rotates with a shaft extending through the first door and to which a handle is attached. In the secured position, the latch plate rotates behind a flange extending from an interior wall, thereby preventing the door from being pulled open. The internal wall divides the cabinet into low and high voltage compartments and forms a structural portion of the cabinet. A bolt extends through the first door, the second door, the latch plate and the flange, thereby preventing the doors from being pulled open and preventing rotation of the handle. A cylinder attached to the first door surrounds the head of the bolt and prevents access thereto. The shackle of a padlock ends through the handle and the cylinder, thereby preventing rotation of the handle and further restricting access to the bolt.

21 Claims, 6 Drawing Sheets

TRANSFORMER HAVING AN INTEGRAL CABINET WITH DOOR LATCHING AND LOCKING APPARATUS

BACKGROUND OF THE INVENTION

The current invention relates to a transformer having an integral cabinet which features an apparatus for latching and locking the doors of the cabinet.

Transformers for commercial and residential electrical service are often mounted on the ground external to the structures they serve. Although such transformers are housed in integrally formed cabinets to deny access to unauthorized personnel, as well as to protect the transformer from the weather, they are vulnerable to tampering by vandals and small children. Doors are provided in such cabinets to allow access to the transformer for installation, maintenance and service. Ensuring that these doors can not be opened by unauthorized personnel is of prime importance in preventing tampering.

In the past, such doors were secured by a three point latch arrangement. The latching and locking devices associated with this prior art arrangement are shown in FIGS. 1 and 2. The first and second latch points were provided by upper and lower rods 112, 113, shown in FIG. 2, which were attached to a cam 110 and which engaged the upper and lower sills (not shown in FIGS. 1 and 2) of the cabinet. As shown in FIG. 1, the cam 110 was attached to the shaft 111 of a vertically extending handle 105. The third latch point was provided by a latch 106 which was attached to a threaded portion 120 of the cam 110 and engaged a flange 107 which extended from an interior barrier 100. The latch 106 was prevented from unlatching by a bolt 108 extending through the door 102 and threaded into the cam 110. The door 101 was retained behind the door 102. A cylinder 104 surrounded the head of the bolt 108 and, along with a padlock 103, prevented the bolt from being removed. The padlock 103 also prevented rotation of the handle 105 by securing a bracket 104 extending from the handle to the cylinder 104. A spring 109 was installed under the head of the bolt to facilitate its removal.

Unfortunately, there was sufficient flexibility in the latching system shown in FIGS. 1 and 2 to allow the latohes to be sprung by applying sufficient outward force to the doors. Such force caused the rods 112, 113 to be bent out of engagement with the sills and latch 106 to be bent out of engagement with the flange 107.

Accordingly, it would be desirable to provide an apparatus for latching and locking the cabinet doors which fasten the doors directly to a structural member of the cabinet so that the latch can not be sprung by merely bending the latching elements.

SUMMARY OF THE INVENTION

It is the object of the current invention to provide a transformer having an integral cabinet with a latching and locking apparatus for the cabinet doors.

It is another object of the current invention that such latching and locking apparatus be resistant to tampering by attempts to force the latch.

These and other objects are accomplished in a transformer having an integral cabinet. The cabinet has exterior side walls attached to a rear wall and an interior wall which divides the cabinet into low and high voltage compartments. First and second doors are rotatably attached to the exterior sidewalls by hinges. The doors are opened by a handle having a shaft which extends through the first door. A latch plate, adapted to engage a flanged portion of the interior wall, is attached to the shaft. A bolt extends through the first door, flange and latch plate, thereby fastening these components together and preventing rotation of the handle or the opening of the doors. A cylindrical member attached to the first door surrounds the head at the bolt, restricting access thereto. A padlock secures the handle to the cylindrical member and further restricts access to the bolt.

DESCRIPTION OF THE PREFERRED EMBODIMENT

Figure 1:
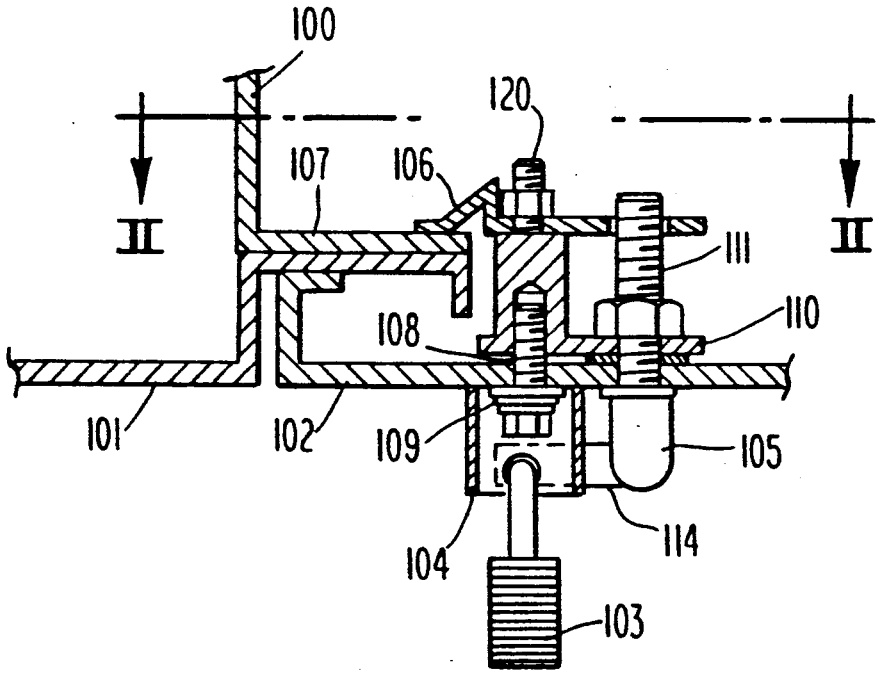
PRIOR ART Fig. 1
FIG. 1 is a cross-section through the latching and locking apparatus according to the prior art.
Figure 2:
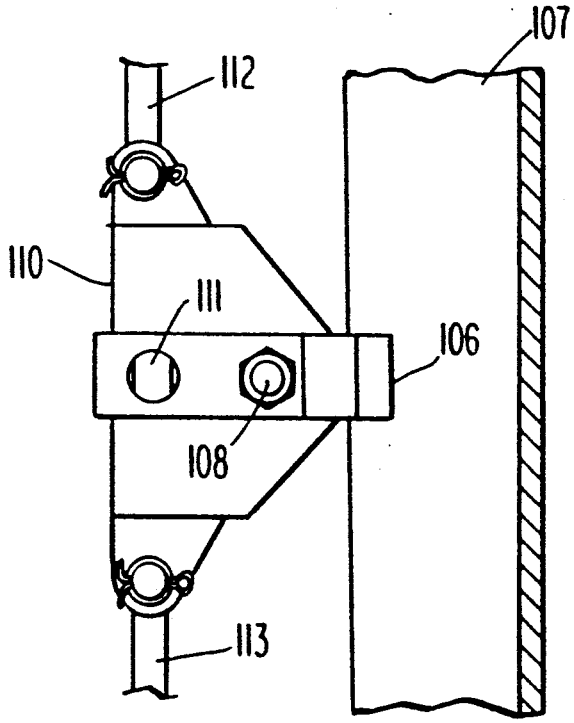
PRIOR ART Fig. 2
FIG. 2 is view taken along line II–II shown in FIG. 1.
Figure 3:
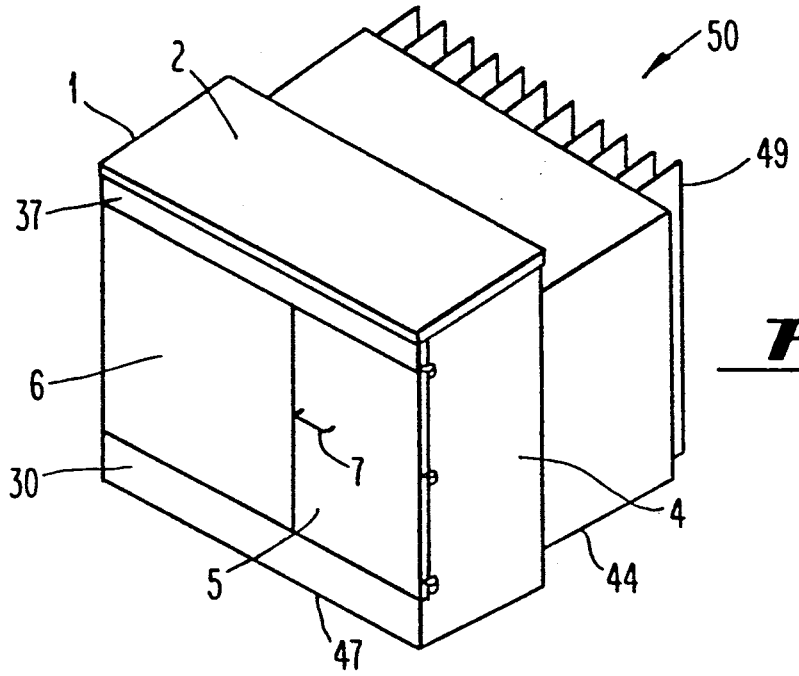
FIG. 3 is an isometric view of the cabinet according to the current invention.
Figure 4:
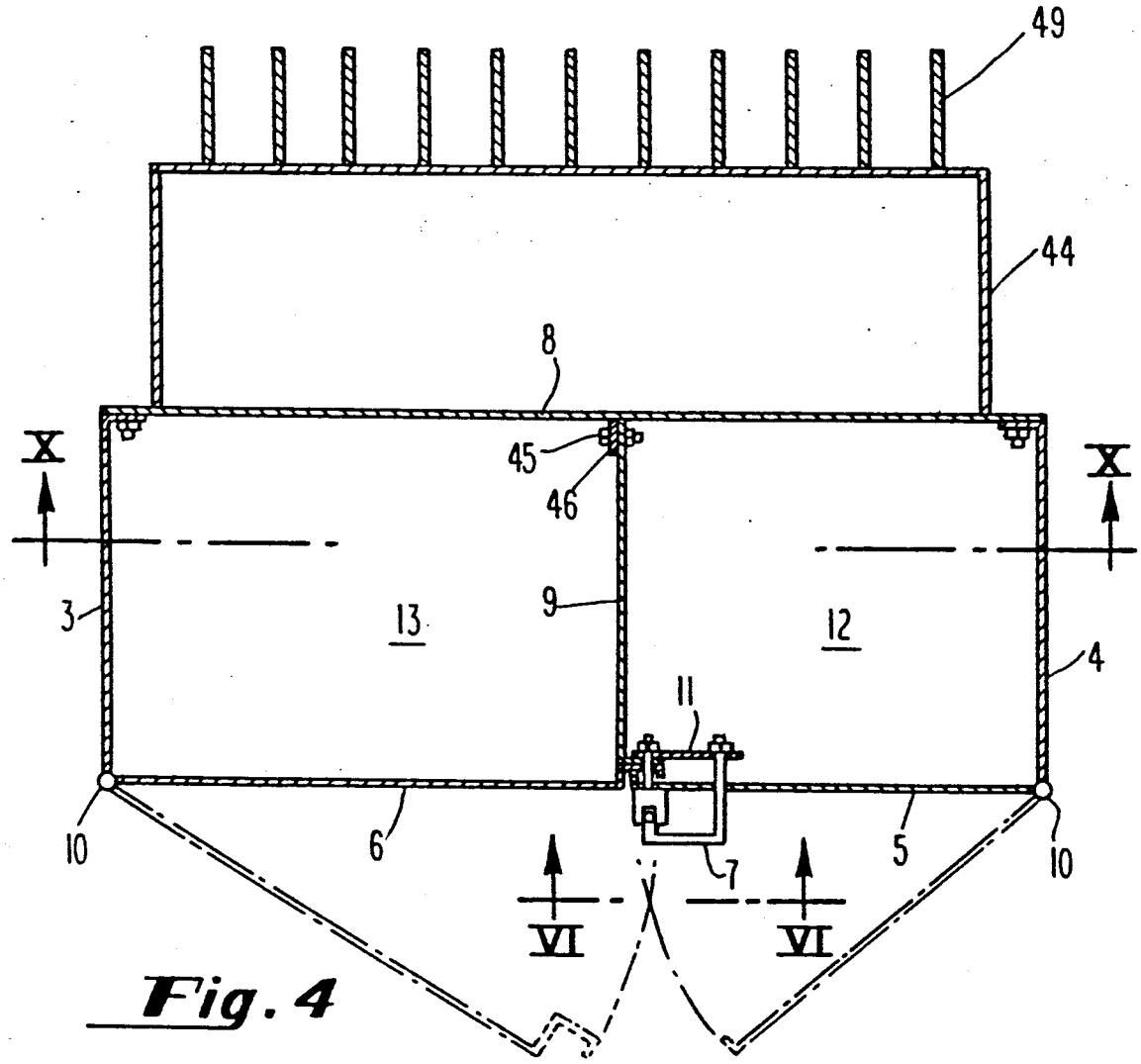
FIG. 4 is a horizontal cross-section through the cabinet shown in FIG. 3.
Figure 10:
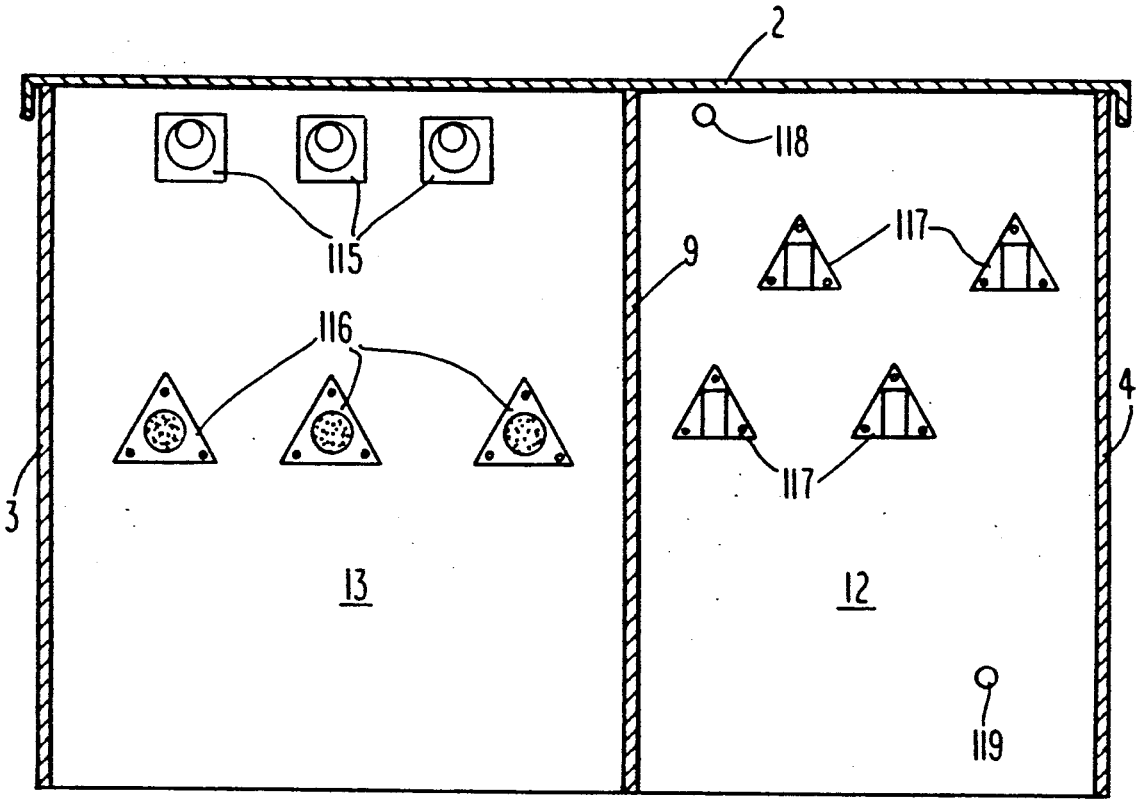
FIG. 10 a cross-section through line X—X shown in FIG. 4.

There is shown in FIG. 3 an electrical transformer 50 having an integral cabinet 1. As shown in FIGS. 3 and 4, the transformer has an oil tank 44, which contains the transformer coils (not shown). A transformer front panel 8 is formed on the front of the tank 44 and a plurality of cooling fins 49 extend from the rear of the tank. The transformer front panel 8 is formed from steel approximately 0.30 cm (0.12 inch) thick and, as shown in FIG. 10, may typically contain low 117 and high 116 voltage bushings, drawout fuses 115, and fill and drain plugs 118 and 119, respectively.

The cabinet 1 is weather tight and is comprised of a cover 2 and vertically oriented exterior side walls 3 and 4 extending between the cover 2 and base 47 of the cabinet. As shown in FIG. 4, the transformer front panel 8 forms the rear wall of the cabinet. The side walls 3 and 4 extend from the transformer front panel 8 and are formed from steel approximately 0.290 cm (0.090 inch) thick.

Figure 5:
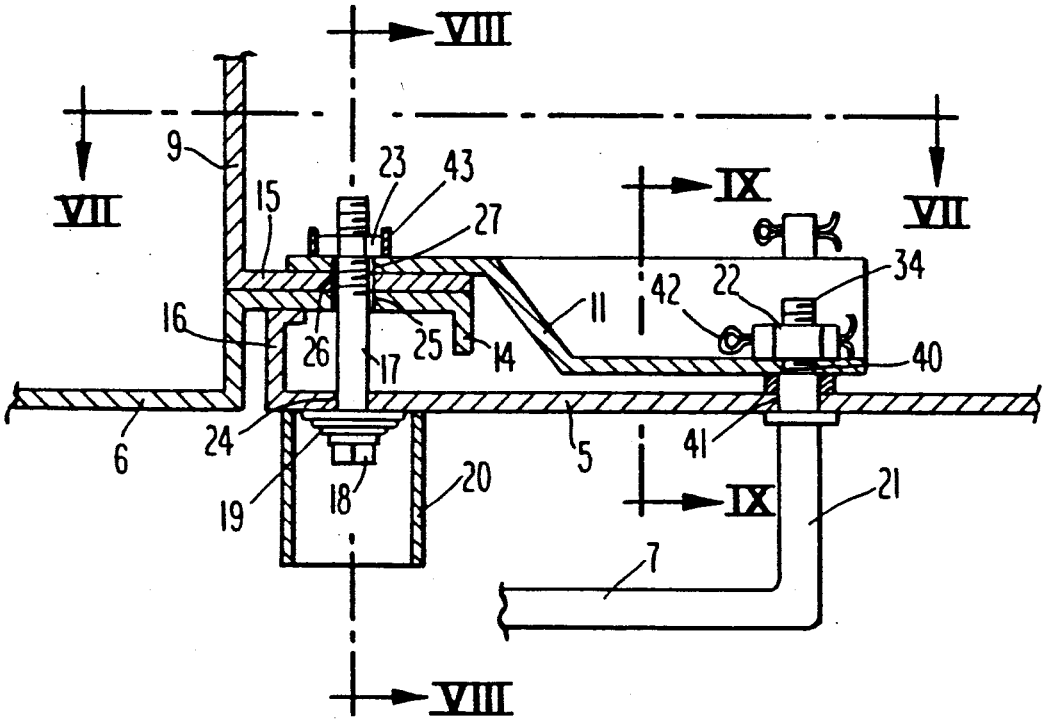
FIG. 5 is a cross-section through line V—V shown in FIG. 4.
Figure 7:
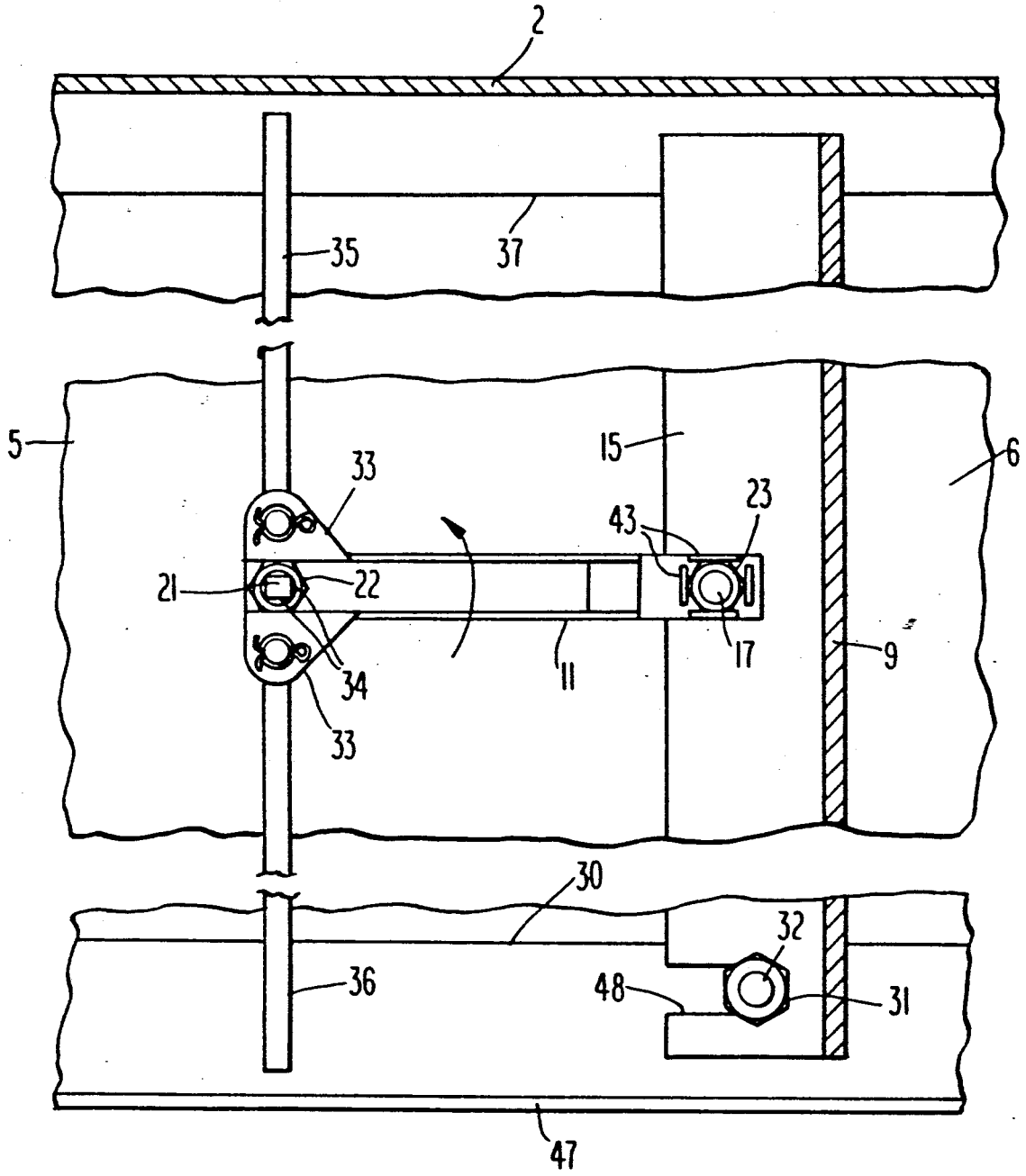
FIG. 7 is a cross-section through line VII—VII shown in FIG. 7.

The cabinet 1 is divided into low and high voltage compartments 12 and 13, respectively, by a vertical internal wall 9—referred to as a barrier. The barrier 9 extends almost the entire height of the cabinet, stopping just short of the cover 2 and base 47, as shown in FIG. 7. As shown in FIG. 5, a flange 15 extends perpendicularly from the barrier 9 along its front edge. The barrier 9 is also formed from approximately 0.290 cm (0.090 inch) thick steel and is securely attached to both the transformer front panel 8 and the bottom sill 30, as explained below. Thus, the barrier 9 forms a structural portion of the cabinet—that is, the barrier contributes to the overall strength and stiffness of the cabinet 1. The barrier 9 is attached at its rear edge to the transformer front panel 8 by bolts 45 disposed through brackets 46, one each of which is shown in FIG. 4, and is attached at its front edge to the bottom sill 30 by a bolt 32 and nut 31 disposed in a slot in the flange 15, as shown in FIG. 7.

Figure 9:
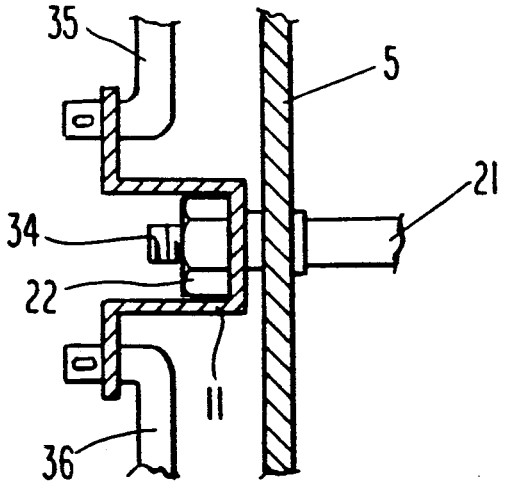
FIG. 9 is a cross-section through line IX—IX shown in FIG. 5.

Access to the low and high voltage compartments is gained by doors 5 and 6, respectively, located in the front of the cabinet 1. The doors 5 and 6 are rotatably attached to the side walls 3 and 4 via hinges 10. The low voltage compartment (LVC) door 5 is secured by a three point latching system. The first latch is comprised of a latch plate 11, shown in FIGS. 5, 7 and 9. The latch plate 11 has a square hole 40 formed in one end through which is disposed the threaded portion of a shaft 21, as shown in FIG. 5. The portion of the shaft 21 disposed through square hole 40 has flats 34 formed therein so as to mate with hole 40. A castle nut 22, locked onto the shaft 21 via a cotter pin 42, serves to secure the latch plate 11 onto the shaft. The shaft 21 extends through a hole 41 in the LVC door 5 and a handle 7 is formed on the distal end of the shaft.

Figure 6:
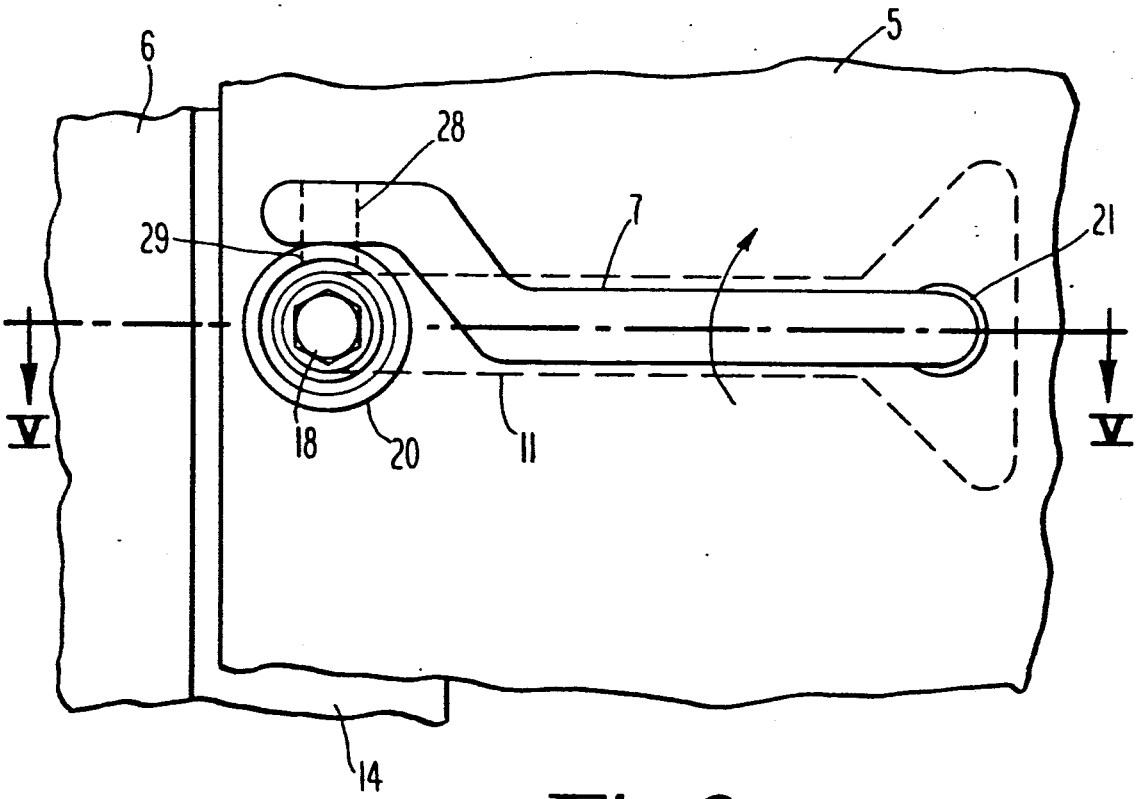
FIG. 6 is a view taken along line VI—VI shown in FIG. 6.

As shown in FIGS. 5 and 7, in its secured position, the latch plate 11 is oriented horizontally so that its end opposite the shaft 21 is disposed inboard of, and adjacent to, the flange 15. Thus, the latch plate is said to "engage" the flange 15. The latch plate 11 is engaged and disengaged by rotating the shaft 21 via the handle 7, thereby rotating the latch plate about the center line of the shaft 21. The latch plate 11 is oriented with respect to the handle 7 such that the latch plate and handle lie in the same plane. Thus, as shown in FIG. 6, in the secured position the handle 7 is oriented horizontally and the end of the handle rests against a cylindrical shaped tubular member 20 affixed to the LVC door 5.

As shown in FIG. 5, when the latch plate 11 is in its secured position, the flange 15 is disposed between the latch plate 11 and the LVC door 5. Thus, pulling on the handle 7 will result in the latch plate 11 bearing against the flange 15, thereby preventing the opening of the LVC door 5. As previously discussed, the barrier 9, on which the flange 15 is formed, is a structural member of the cabinet, being formed from relatively thick steel and bolted to both the transformer front panel 8 and the bottom sill 30 of the cabinet. Thus, extreme force would be required to force latch plate 11 out of its engagement with the flange 15 by deforming the flange. In addition, in the preferred embodiment, the latch plate 11 has a channel-shaped cross-section, shown in FIG. 9, giving it additional stiffness so that the latch can not be forced by deforming the latch plate 11.

As shown in FIG. 5, the high voltage compartment (HVC) door 6 is secured by a channel 14 extending along its vertical edge. In the closed position, the channel 14 is interposed between the flange 14 and a lip 16 extending perpendicularly from the LVC door 6 along its vertical edge. Thus, securing the LVC door 5 also serves to secure the HVC door 6.

Figure 8:
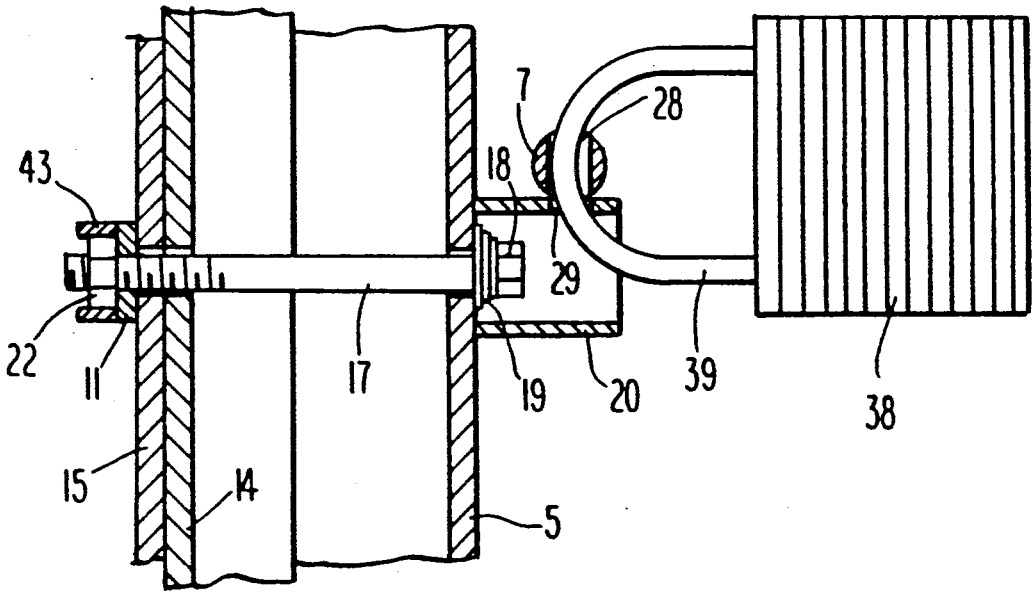
FIG. 8 is a cross section through line VIII—VIII shown in FIG. 7.

As shown in FIG. 5, according to an important aspect of the current invention, the doors 5 and 6 and the latch plate 11 are fastened to the flange 15 by a bolt 17 which extends through holes 24, 25, 26 and 27 formed in the LVC door 6, HVC door channel 14, flange 15 and latch plate 11, respectively. The bolt 17 is secured by a hex nut 23 threaded onto the bolt. The hex nut 23 bears against the latch plate 11 and is held captive thereto by tabs 43, shown in FIGS. 7 and 8, projecting from the latch plate. Thus, bolt 17 and nut 23 lock the doors in the closed position by preventing both the rotating of the latch plate 11, and therefore the handle 7, and the pulling open of the doors. As shown in FIGS. 6 and 8, the cylindrical member 20 surrounds the head 18 of the bolt 17, thereby restricting access to the bolt head 18 unless a thin-walled deep socket wrench is used.

The second and third latching points are achieved by upper and lower latch rods 35 and 36, respectively, shown in FIG. 7. In the latched position, the outboard end of each of the latch rods 35, 36 engages inboard of the top 37 and bottom 30 sills of the cabinet, thereby preventing the LVC door 5 from being opened. The inboard end of each of the latching rods is rotatably attached to a cam 33 formed on the latch plate 11. The ends of the latch rods 35, 36 are disposed in holes in the cam 33 and retained thereto by cotter pins. The cam 33 is positioned on the latch plate 11 so that when the latch plate is in the horizontal orientation, as shown in FIG. 7, the latch rods 35, 36 are thrust radially outward, thereby causing them to engage the sills 30, 37. Rotation of the latch plate 11 about the axis of the shaft 21 causes the cam 33 to pull the latch rods 35, 36 radially inward so that they disengage from the sills 30, 37.

To ensure that cabinet 1 is not opened by unauthorized personnel, a padlock 38 is installed. The shackle 39 of the padlock is inserted through a hole 28 in the handle 7 and a hole 29 in the cylinder 20, as shown in FIG. 8. In addition to preventing rotation of the handle 7, the shackle restricts access to the bolt head 18, thereby preventing its removal.

The doors 5, 6 are opened by first opening the padlock 38 and withdrawing the shackle 39 from the holes 28 and 29 in the handle 7 and cylinder 20, respectively. The bolt 17 is then unthreaded from the hex nut 22 by inserting a thin-walled deep socket into the cylinder and rotating the bolt head 18. Withdrawal of the bolt 17 from holes 24, 25, 26 and 27 in the LVC door 5, HVC door channel 14, flange 15 and latch plate 11, respectively, allows these components to move relative to one another. As shown in FIG. 8, a helical compression spring 19 is compressed under the bolt head 18 to facilitate withdrawal of the bolt 17.

After removal of the padlock 38 and the bolt 17, the handle is rotated clockwise, when viewed from outside the cabinet 1, as shown in FIG. 6. This rotation causes the latch plate 11 to rotate away from the flange 15 and the latch rods 35, 36 to withdraw from the sills 30, 37, thereby unlatching all three latch points. The LVC door 5 may then be opened by pulling on the handle 7, after which the HVC door 6 may be opened.

The present invention may be embodied in other specific forms without departing from the spirit or central attributes thereof and, accordingly, reference should be made to the appended claims, rather than to the foregoing specification, as indicating the scope of the invention.

What is claimed is:

1. An electrical transformer structure comprising:

(a) a tank having a front panel;

(b) an enclosure having first and second walls extending from said front panel, said first wall having a first door rotatably attached thereto;

(c) an interior wall disposed within said enclosure and forming a structural portion thereof;

(d) a handle having a shaft extending through said first door;

(e) means for latching said first door, said latching means being adapted to engage said interior wall and attached to said shaft; and (f) means, extending through said interior wall, for fastening said first door and said latching means to said interior wall.

2. The transformer according to claim 1 further comprising a second door rotatably attached to said second wall, and wherein said fastening means also has means for fastening said second door to said interior wall.

3. The transformer according to claim 2 wherein said interior wall has a flange extending therefrom, said latching means engaging said flange, said fastening means fastening said latching means and said first and second doors to said flange.

4. The transformer according to claim 3 wherein said fastening means comprises a bolt extending through said first and second doors, said flange and said latching means.

5. The transformer according to claim 4 wherein said interior wall divides said enclosure into first and second compartments.

6. The transformer according to claim 5 wherein said enclosure further comprising a rear wall and a front sill, said interior wall attached to said rear wall and said front sill.

7. The transformer according to claim 4 wherein said latching means comprises a latch plate having first and second ends, said first end attached to the distal end of said shaft and adapted to rotate about the axis of said shaft, said second end engaging said flange by rotating about said axis of said shaft so as to dispose said latch plate inboard of and adjacent to said flange 8. The transformer according to claim 3 further comprising means for restricting access to said fastening means.

9. The transformer according to claim 8 further comprising means for securing said handle to said access restricting means.

10. The transformer according to claim 9 wherein:

(a) said fastening means comprises a bolt extending through said first door and said interior wall; and (b) said access restricting means comprises a tubular member affixed to said first door and surrounding the head of said bolt.

11. The transformer according to claim 10 further comprising a spring disposed under said bolt head.

12. The transformer according to claim 10 wherein said bolt also extends through said latching means, whereby said bolt fastens said latching means to said interior wall.

13. The transformer according to claim 12 wherein said bolt also extends through said second door, whereby said bolt fastens said second door to said interior wall.

14. The transformer according to claim 10 wherein said means for securing said handle to said access restricting means comprises a padlock.

15. The transformer according to claim 14 wherein said padlock has a shackle and said access restricting means further comprises said shackle extending through said tubular member.

16. A cabinet for housing an electrical transformer comprising:

(a) first and second exterior side walls, each of said exterior side walls extending between a cover and a base;

(b) first and second doors hinged to said first and second exterior sidewalls, respectively;

(c) an interior wall dividing said cabinet into high voltage and low voltage compartments, said interior wall having a flange extending therefrom, said second door adapted to extend between said first door and said flange;

(d) first latching means for securing said first door to said flange; and (e) a bolt extending through said first door, said flange and said first latching means, thereby fastening said first door and said first latching means to said flange.

17. The cabinet according to claim 16 further comprising:

(a) handle having a shaft to which said first latching means is attached, said first latching means adapted prevent rotation of said shaft when said first latching means is fastened to said flange by said bolt; and (b) second and third latching means rotatably attached to said first latching means for securing said first door, said second and third latching means adapted for operation upon rotation of said shaft.

18. The cabinet according to claim 16 further comprising:

(a) a cylindrical member affixed to said first door and surrounding the head of said bolt, said cylindrical member having a hole formed therein; and (b) a padlock having a shackle extending through said hole.

19. In a transformer enclosure having top and bottom sills, first and second doors and a vertically extending interior wall dividing said enclosure into high voltage and low voltage compartments, a tamper resistant locking device for securing said first and second doors, comprising:

(a) first and second latching means for securing said first door to said top and bottom sills, respectively;

(b) third latching means for securing said first door to said interior wall;

(c) a handle for operating said first, second, and third latching means; and (d) first means, fastened to said third latching means and said interior wall, for preventing rotation of said handle.

20. The locking device according to claim 19 further comprising second means for preventing rotation of said handle, said second handle rotation prevention means having means for restricting access to said first handle rotation prevention means.

21. The device according to claim 20 wherein (a) said first handle rotation prevention means comprises a bolt extending through said third latching means and said interior wall; and (b) said second handle rotation prevention means comprises a padlock and a member surrounding the head of said bolt;

(c) said access restricting means comprises the shackle of said padlock, said shackle extending through holes formed in said member and said handle.

* * * * *